US007604309B2

(12) United States Patent
Chen et al.

(10) Patent No.: US 7,604,309 B2
(45) Date of Patent: Oct. 20, 2009

(54) AUTO RELEASE RETAINING MECHANISM OF A SLIDE

(75) Inventors: Ken-Ching Chen, Kaohsiung Hsien (TW); Shih-Ling Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 645 days.

(21) Appl. No.: 11/334,448

(22) Filed: Jan. 19, 2006

(65) Prior Publication Data

US 2007/0164645 A1 Jul. 19, 2007

(51) Int. Cl.
*A47B 95/00* (2006.01)

(52) U.S. Cl. ..... 312/334.46; 312/333

(58) Field of Classification Search ..... 312/333, 312/334.44–334.47; 384/21
See application file for complete search history.

(56) References Cited

U.S. PATENT DOCUMENTS

| | | | | |
|---|---|---|---|---|
| 5,730,514 | A | 3/1998 | Hashemi | |
| 6,126,255 | A | 10/2000 | Yang | |
| 6,257,683 | B1 | 7/2001 | Yang | |
| 6,367,899 | B1 * | 4/2002 | Hwang et al. | 312/334.47 |
| 6,375,290 | B1 | 4/2002 | Lin et al. | |
| 6,390,575 | B1 | 5/2002 | Chen et al. | |
| 6,402,275 | B1 | 6/2002 | Yang | |
| 6,412,891 | B1 | 7/2002 | Liang et al. | |
| 6,450,600 | B1 | 9/2002 | Chen et al. | |
| 6,457,790 | B1 | 10/2002 | Liang et al. | |
| 6,585,337 | B1 | 7/2003 | Chen et al. | |
| 6,764,150 | B2 | 7/2004 | Le et al. | |
| 6,851,774 | B2 * | 2/2005 | Chen et al. | 312/334.47 |
| 6,860,575 | B2 * | 3/2005 | Chen et al. | 312/334.46 |
| 6,935,710 | B2 | 8/2005 | Chen et al. | |
| 6,945,619 | B1 | 9/2005 | Chen et al. | |
| 7,101,081 | B2 * | 9/2006 | Chen et al. | 384/21 |
| 7,413,269 | B2 * | 8/2008 | Chen et al. | 312/333 |
| 2005/0248247 | A1 | 11/2005 | Huang | |

FOREIGN PATENT DOCUMENTS

| | | | | |
|---|---|---|---|---|
| EP | 107525 | * | 5/1984 | 312/333 |

* cited by examiner

*Primary Examiner*—Hahn V Tran
(74) *Attorney, Agent, or Firm*—Rosenberg, Klein & Lee

(57) ABSTRACT

An automatic release retaining mechanism of a slide includes a locating member, an elastic member, and a retaining member operating in conjunction with a first rail and a second rail. The second rail passes through and slides on the first rail. The locating member and the elastic member are disposed on the second rail. The retaining member is disposed on the first rail. The elastic member applies pressure upon the locating member. The locating member holds against the retaining member to temporarily secure the second rail when the second rail slides and extends in relation to the first rail. The second rail is automatically released to be retracted into the first rail when the second rail is pushed into the first rail.

2 Claims, 9 Drawing Sheets

AUTO RELEASE RETAINING MECHANISM OF A SLIDE

BACKGROUND OF THE INVENTION (a) Field of the Invention

The present invention relates to a retaining mechanism that can be automatically released in a slide, and more particularly, one that allows temporary positioning when a first rail and a second rail of the slide extend in relation to each other and automatic release when the slide is retracted.

(b) Description of the Prior Art

Whereas a slide generally available in the market designed with comparatively more powerful functions relates to one that when a mobile rail extends, it is prevented from easily sliding into a fixed rail again, meaning that the mobile rail will be retained by the fixed rail and prevented from retracting when extended. This kind of locating function to prevent retraction is found in two modes, "secured locking" and "elastically temporary locating"; wherein, the former operates in conjunction with a control member to release the locking so as to push the mobile rail back into the fixed rail; and the latter relies upon applying a certain impetus to the mobile rail to automatically release the locking so as to further push the mobile rail into the fixed rail.

The inventor of this application is entitled with many patents working on the Secured Locking mode including U.S. Pat. Nos. 6,367,899 B1, 6,375,290 B1, 6,390,575 B1, 6,412,891 B1, 6,450,600 B1, 6,585,337 B1, 6,851,774 B2, 6,935,710 B2, and prior arts including U.S. Pat. Nos. 5,730,514, 6,764,150 B2, and Application No. US2005/0248247 A1 that can be cited for references.

In the case of the "elastically temporary locating" mode, the inventor of this application is the owner of patents including U.S. Pat. Nos. 6,457,790 B1, and 6,945,619 B1; and prior arts including U.S. Pat. Nos. 6,126,255, 6,257,683 B1 and 6,402,275 B1.

On considering that depending on the use occasion of the slide, mechanism demands and assembly of components may vary; the present invention is an improvement to the U.S. Pat. No. 6,945,619 to further bring a summary and precise space of construction members.

SUMMARY OF THE INVENTION

The primary purpose of the present invention is to provide an auto release retaining mechanism of a slide that allows temporary locating when a first rail and a second rail of the slide extend in relation to each other and the automatic release for the second rail to be received into the first rail when retracted.

To achieve the purpose, the present invention includes a locating member, an elastic member, and a retaining member operating in conjunction with a first rail and a second rail. The second rail slides into the first rail. The locating member and the elastic member are disposed on the second rail. The retaining member is disposed on the first rail. The elastic member applies pressure upon the locating member for it to hold against the retaining member when the second rail slides in relation with the first rail and extends to its extreme. The locating member includes a chute, an angular portion, a guide grain, and a locking member. The elastic member is fixed to the second rail and holds against the locating member. A guide section is disposed to the second rail and an inclined guide edge is provided to the guide section. The locking member passes through the chute to connect the locating member to the second rail with the guide grain to pass through the second rail to slide on the guide section and hold against the inclined guide edge.

Alternatively, the present invention may include a locating member, an elastic member, a positioning member, and a retaining member operating in conjunction with a first rail and a second rail. The second rail slides into the first rail. The locating member, the elastic member, and the positioning member are provided on the second rail. The retaining member is disposed on the first rail. The elastic member applies pressure upon the locating member and the positioning member so that when the second rail slides in relation to the first rail and extends to its extreme, both the locating member and the positioning member relatively hold against both ends of the retaining member. The locating member includes a chute, an angular portion, a guide grain, and a locking member. The elastic member is fixed to the second rail and holds against the locating member and the positioning member. The second rail is disposed with a guide section containing an inclined guide edge. The locking member passes through the chute to connect the locating member to the second rail while the guide grain of the locating member passes through to slide on the guide section of the second rail with the guide grain holding against the inclined guide edge.

Furthermore, the present invention may include a locating member, an elastic member, a positioning member, a retaining member, and a breakaway pull operating in conjunction with a first rail and a second rail. The second rail slides in the first rail. The locating member, the elastic member, the positioning member and the breakaway pull are disposed on the second rail, and the retaining member is disposed on the first rail. The elastic member applies pressure upon the locating member and the positioning member. The elastic member is provided with an extension portion to restrict the breakaway pull. Both the locating member and the positioning member relatively hold against both ends of the retaining member when the second rail slides in relation to the first rail and extends to its extreme. The locating member includes a chute, an angular portion, a guide grain, and a locking member. The elastic member is fixed to the second rail and holds against the locating member and the positioning member. The guide section is disposed to the second rail and contains an inclined guide edge. The locking member passes through the chute to connect the locating member to the second rail. The guide grain of the locating member passes through and slides on the guide section of the second rail to hold against the inclined guide edge. The breakaway pull is inserted to slide on the second rail and an erected bit is disposed to the breakaway pull in relation to the positioning member which in turn driven by sliding the breakaway pull to have the erected bit to hold against the positioning member.

In comparison with the prior art, the present invention provides advantages that it makes easier the assembling of the elements of the mechanism within the limited space available by the second rail, and allows savings of certain parts without compromising its functionality to reduce production cost and upgrade competition strength in the market.

DETAILED DESCRIPTION OF THE PREFERRED EMBODIMENTS

Figure 1:
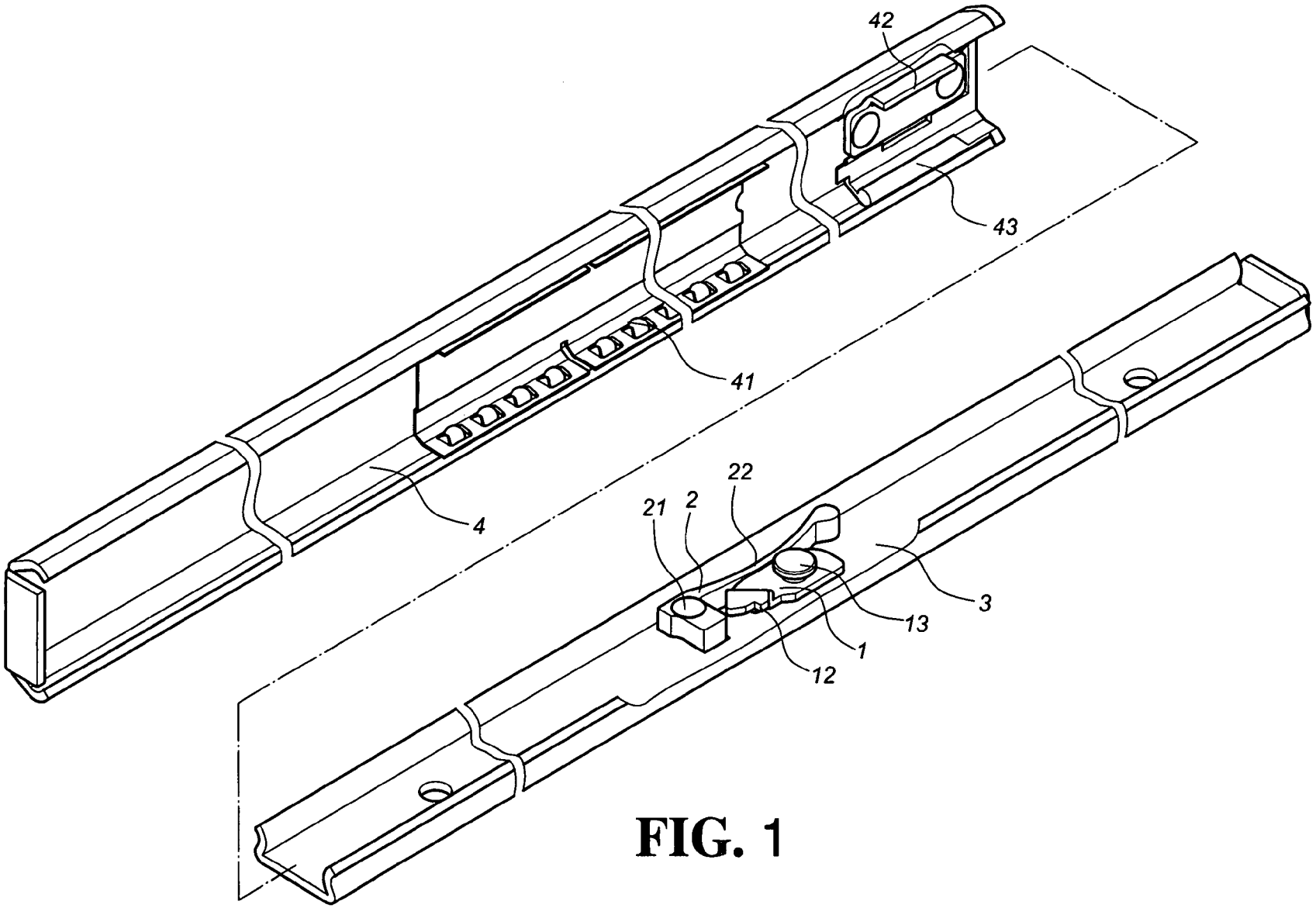
FIG. 1 is a perspective view of a preferred embodiment of the present invention applied in a slide.
Figure 2:
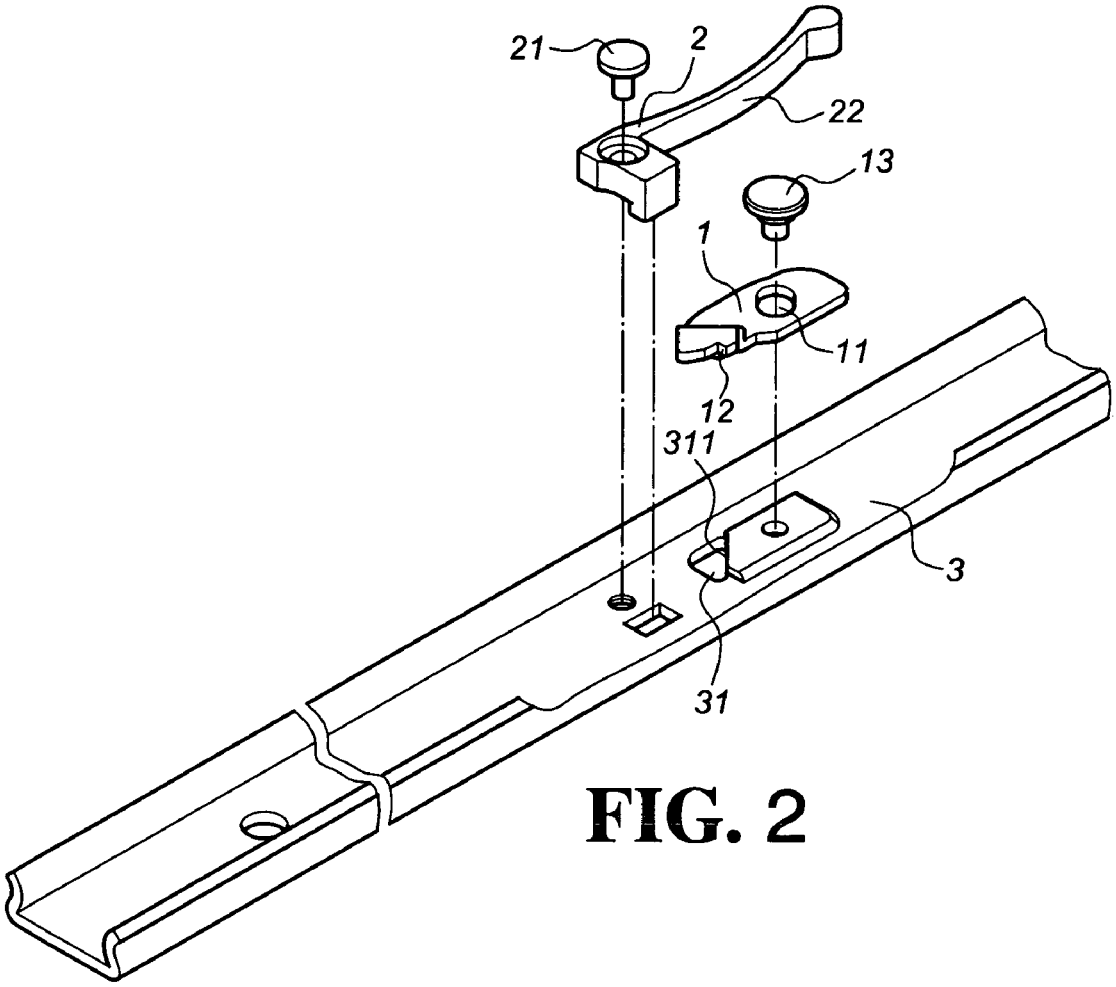
FIG. 2 is an exploded view of the preferred embodiment of the present invention.
Figure 3:
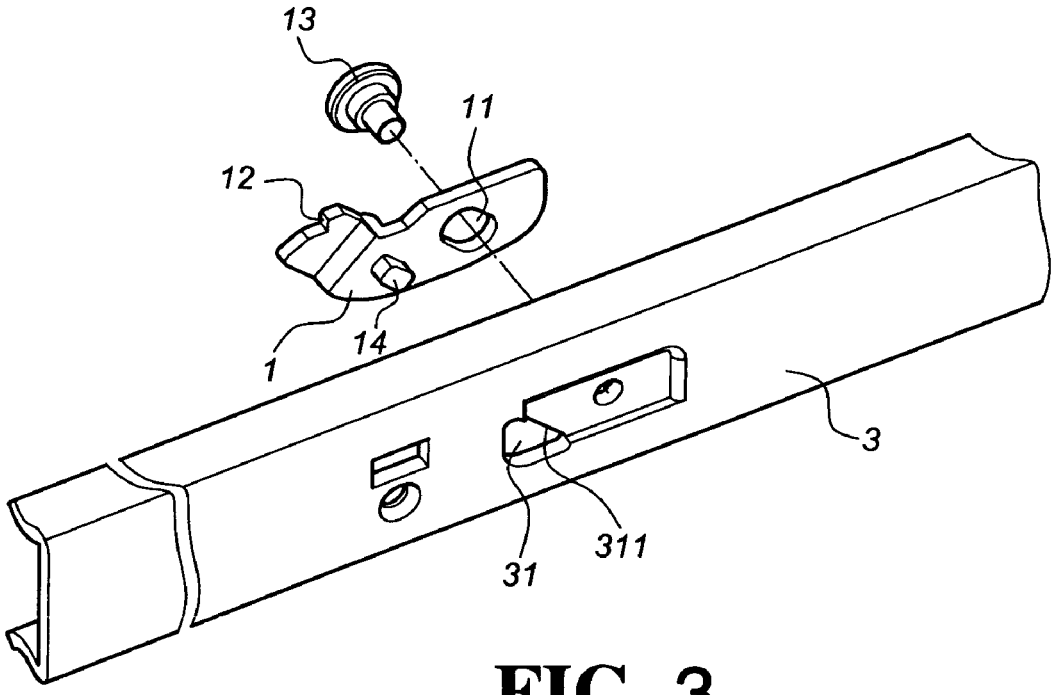
FIG. 3 is another exploded view of the preferred embodiment of the present invention.

Referring to FIGS. 1, 2, and 3, a preferred embodiment of the present invention includes a locating member (1), an elastic member (2) and a retaining member (42) operating in conjunction with a first rail (4) and a second rail (3) of a slide. The second rail (3) passes the first rail (4) and slides on a roller bearing (41) built in. The retaining member (42) and a holder (43) are separately provided to the first rail (4). Generally, the first rail (4) is an outer rail, i.e., a fixed rail; and the second rail (3), an inner rail, i.e., a mobile rail.

Both the locating member (1) and the elastic member (2) are disposed to the second rail (3). The retaining member (42) is provided to the first rail (4). The elastic member (2) applies pressure on the locating member (1). The locating member (1) holds against the retaining member (42) when the second rail (3) slides and extends in relation to the first rail (4). The locating member (1) includes a chute (11), an angular portion (12), a locking member (13), and a guide grain/post (14). The elastic member (2) is fixed to the second rail (3) by means of a locking member (21) and has a first elastic arm (22) to hold against one side of the locating member (1). A guide section (31) is provided on the second rail (3) and the guide section (31) contains an inclined guide edge (311). The locking member (13) passes through the chute (11) to connect the locating member (1) to the second rail (3), and the guide grain/post (14) of the locating member (1) passes through and slides on the guide section (31) of the second rail (3) to relatively hold against the inclined guide edge (311).

Figure 4:
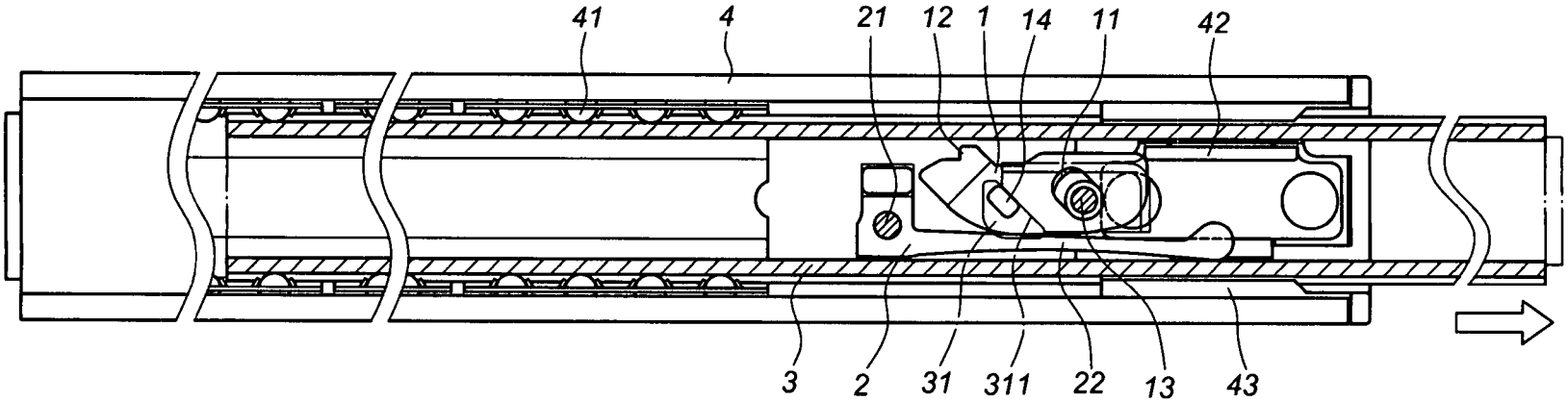
FIG. 4 is a schematic view showing an operating status of the preferred embodiment of the present invention when a locating member first holds against a retaining member with the slide extends.

FIGS. 4 through 8 respectively show the operating status of the preferred embodiment of the present invention. As illustrated in FIG. 4, when the slide i.e., the second rail (3) and the first rail (4), extends and the locating member (1) moves to where the retaining member (42) is located, the front end of the locating member (1) first contacts the rear end of the retaining member (42).

Figure 5:
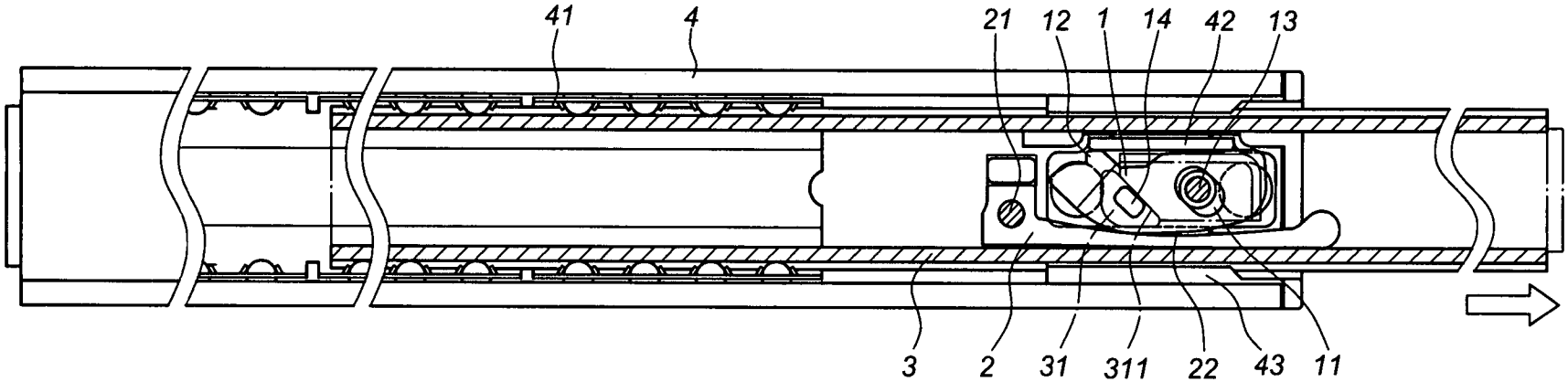
FIG. 5 is a schematic view showing another operating status of the preferred embodiment of the present invention when the locating member retreats at an inclination from the retaining member with the slide further extends.

In FIG. 5, the slide keeps extending; the locating member (1) retreats at an inclination by the chute (11) along the locking member (13); and the guide grain (14) inches in the guide section (31) to allow the locating member (1) defects at mild angle while retreating at a certain inclination.

Figure 6:
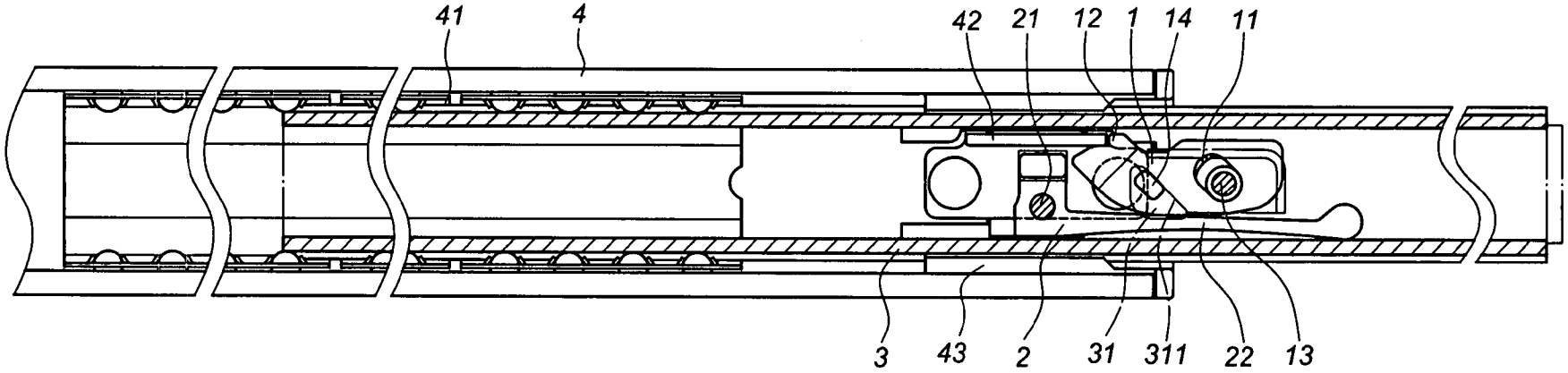
FIG. 6 is a schematic view showing another operating status yet of the preferred embodiment of the present invention when the locating member has its angular portion to hold against the retaining member with the slide extends and is secured in position.

As illustrated in FIG. 6, the slid further extends to its secured position, and the locating member (1) has the angular portion (12) to hold against the front end of the retaining member (42) to temporarily secure the second rail (3) in relation to the first rail (4).

Figure 7:
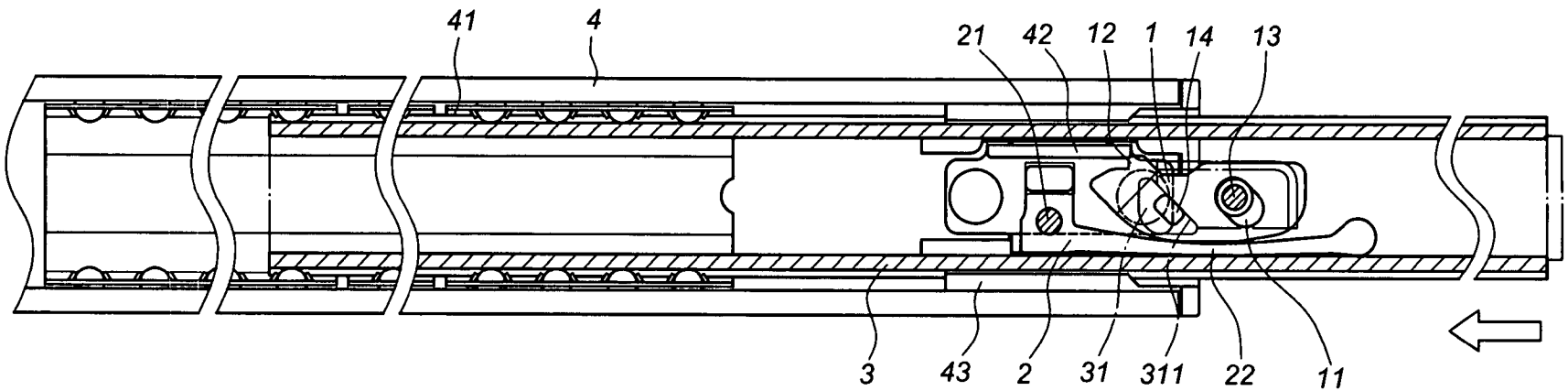
FIG. 7 is a schematic view showing another operating status yet of the preferred embodiment of the present invention when the locating member has its angular portion to hold against the retaining member and is forced to retreat at an inclination from the retraining member.
Figure 8:
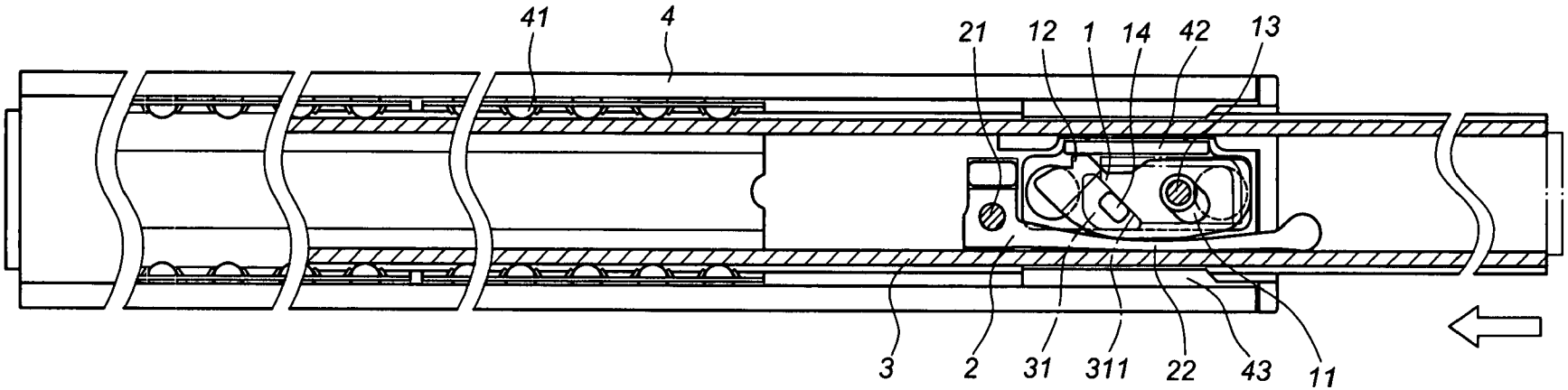
FIG. 8 is a schematic view showing another operating status yet of the preferred embodiment of the present invention when the locating member moves into on one side of the retaining member to be further retracted.

As shown in FIG. 7, when retracting the slide, the locating member (1) first has the angular portion (12) to hold against the retaining member (42). An external force is applied to push the second rail (3) into the first rail (4), as guided by the chute (11) along the locking member (13), the locating member (1) retreats at an inclination by pressing against the first elastic arm (22) of the elastic member (2) with the guide grain (14) to hold against the inclined guide edge (311) of the guide section (31). Subsequently, as illustrated in FIG. 8, the second rail (3) is further pushed in for the locating member (1) to move to rest on one side of the retaining member (42), thus to retract the second rail (3).

Figure 9:
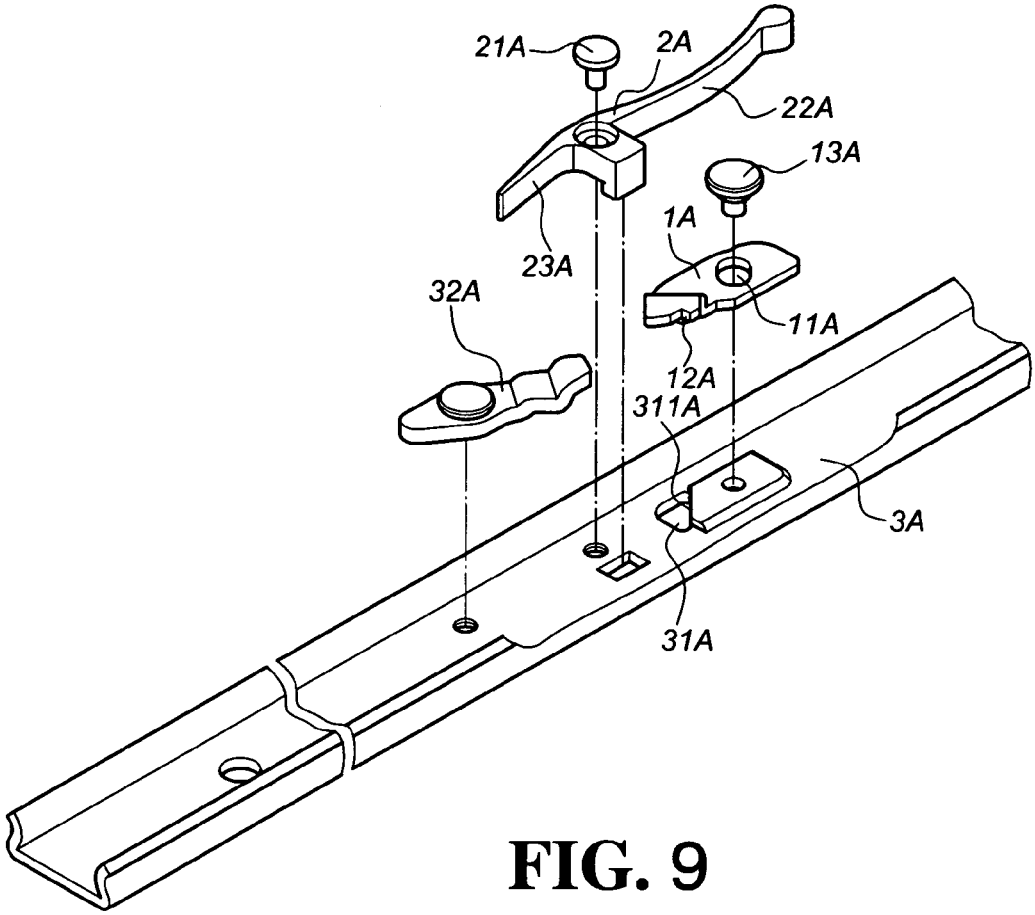
FIG. 9 is an exploded view showing another preferred embodiment of the present invention.
Figure 10:
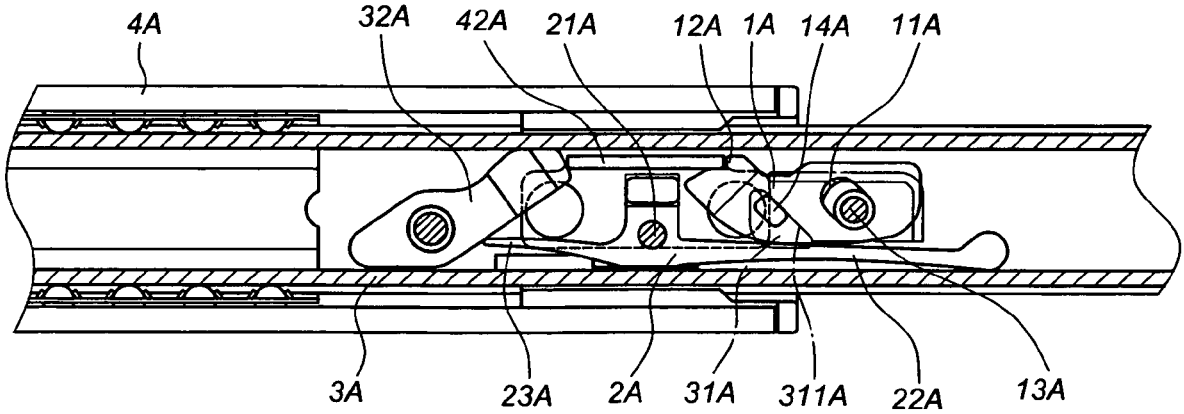
FIG. 10 is a schematic view showing another preferred embodiment of the present invention as assembled.

Now referring to FIGS. 9 and 10, another preferred embodiment of the present invention includes a locating member (1A), an elastic member (2A), a positioning member (32A), and a retaining member (42A) operating in conjunction with a first rail (4A) and a second rail (3A) of a slide. The second rail (3A) passes through and slides in the first rail (4A). The locating member (1A), the elastic member (2A), and the locking member (32A) are provided on the second rail (3A). The retaining member (42A) is disposed on the first rail (4A). The elastic member (2A) applies pressure upon the locating member (1A) and the positioning member (32A) so that when the second rail (3A) slides and extends to its extreme in relation to the first rail (4A), the locating member (1A) and the positioning member (32A) relatively hold against the front end and the rear end of the retaining member (42A). The locating member (1A) includes a chute (11A), an angular portion (12A), a locking member (13A), and a guide grain (14A). The elastic member (2A) is fixed to the second rail (3A) by means of a locking member (21A). The elastic member (2A) is disposed with a first elastic arm (22A) to hold against the locating member (1A), and a second elastic arm (23A) to hold against the positioning member (32A). A guide section (31A) containing an inclined guide edge (311A) is disposed to the second rail (3A). The locking member (13A) passes through the chute (11A) to connect the locating member (1A) to the second rail (3A). The guide grain (14A) of the locating member (1A) passes through the second rail (3A) to slide on the guide section (31A) and holds against the inclined guide edge (311A).

Figure 11:
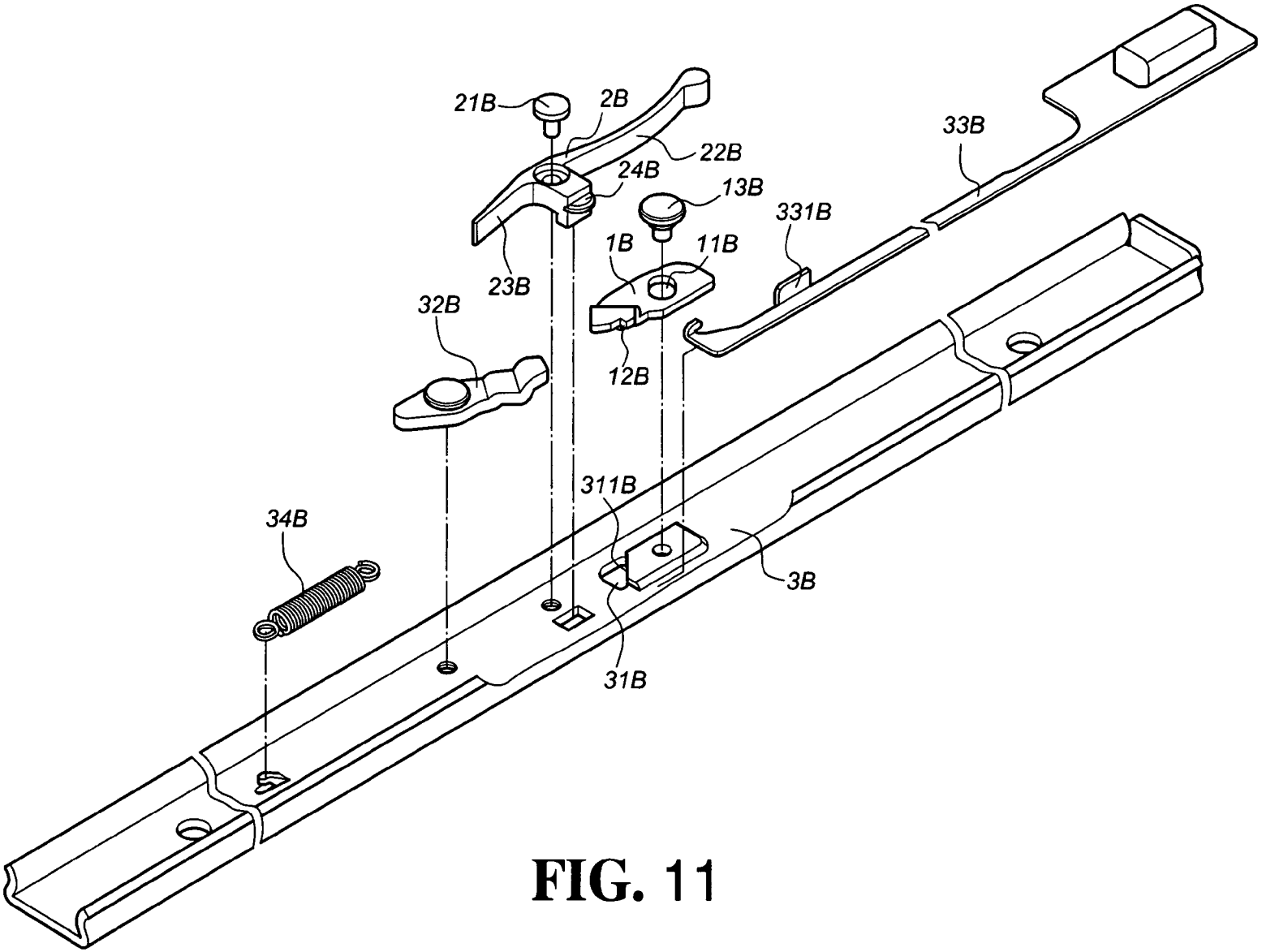
FIG. 11 is an exploded view showing another preferred embodiment yet of the present invention.
Figure 12:
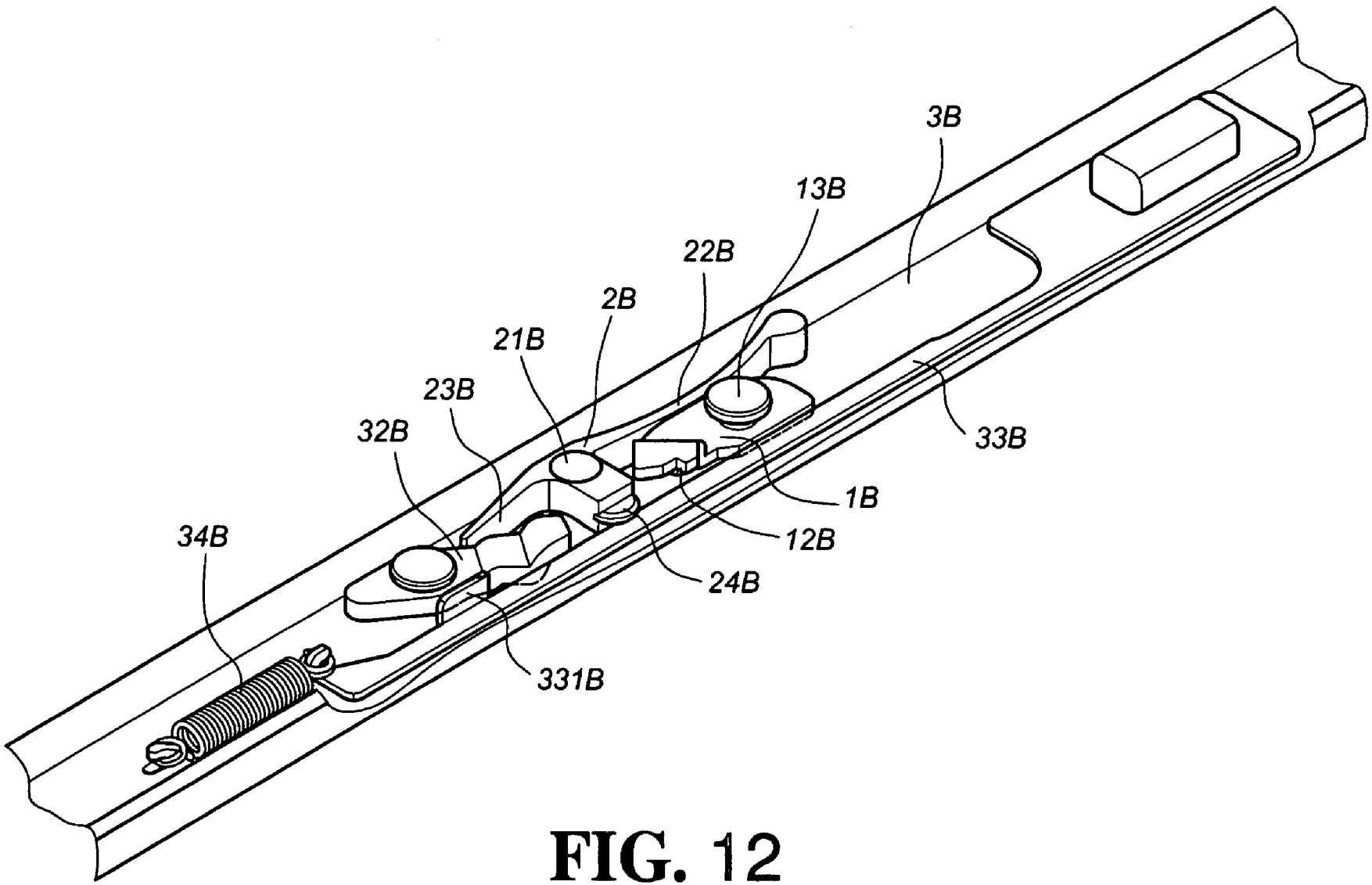
FIG. 12 is a schematic view showing another preferred embodiment yet of the present invention as assembled.
Figure 13:
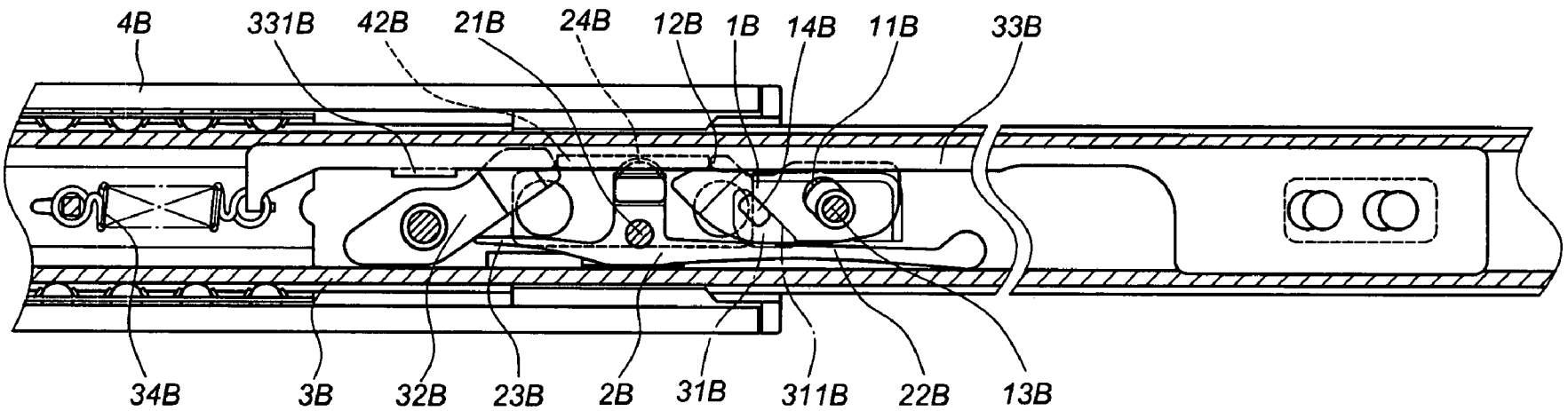
FIG. 13 is a schematic view showing an operating status of another preferred embodiment yet of the present invention.

As illustrated in FIGS. 11, 12, and 13, another preferred embodiment yet of the present invention includes a locating member (1B), an elastic member (2B), a positioning member (32B), a retaining member (42B), and a breakaway pull (33B) operating in conjunction with a first rail (4B) and a second rail (3B) of a slide. The second rail (3B) passes through and slides on the first rail (4B). The locating member (1B), the elastic member (2B), and the positioning member (32B) are provided on the second rail (3B). The retaining member (42B) is disposed to the first rail (4B). The elastic member (2B) is fixed to the second rail (3B) by means of a locking member (21B). The elastic member (2B) apply pressure upon the locating member (1B) and the positioning member (32B) so that when the second rail (3B) slides and extends to its extreme in relation to the first rail (4B), both the locating member (1B) and the positioning member (32B) relatively hold the front end and the rear end of the retaining member (42B). The locating member (1B) includes a chute (11B), an angular portion (12B), a locking member (13B), and a guide grain (14B). The elastic member (2B) fixed to the second rail (3B) has a first elastic arm (22B) and a second elastic arm (23B) to respectively apply pressure upon the locating member (1B) and the positioning member (32B). An extension portion (24B) is provided to the elastic member (2B) to restrict the breakaway pull (33B) from being easily erected in relation to the inner side of the second rail (3B) thus to be flush with and slide along the inner side of the second rail (3B). A guide section (31B) containing an inclined guide edge (311B) is disposed to the second rail (3B). The locking member (13B) passes through the chute (11B) to connect the locating member (1B) to the second rail (3B). The guide grain (14B) of the locating member (1B) passes through the second rail (3B) to slide on the guide section (31B) and hold against the inclined guide edge (311B). The breakaway pull (33B) is inserted to and slides on the second rail (3B). An erected bit (331B) is disposed at the breakaway pull (33B) in relation to the positioning member (32B). The erected bit (331B) pushes to hold against the positioning member (32B) by pulling and sliding the breakaway pull (33B) so that the positioning member (32B) clears away by moving in relation to the retaining member (42B). To achieve the purpose, the breakaway pull (33B) may be further provided with a spring (34B).

What is claimed is:

1. An automatic release retaining mechanism of a slide including a locating member, an elastic member, and a retaining member operating in conjunction with a first rail and a second rail; the second rail passing through and sliding on the first rail; the locating member and the elastic member being disposed on the second rail; the retaining member being disposed on the first rail; the elastic member applying pressure upon the locating member; the locating member holding against the retaining member when the second rail slides and extends in relation to the first rail; the locating member including a chute, an angular portion, a locking member, and a guide post; the elastic member being fixed to the second rail and holding against the locating member; a guide section containing an inclined guide edge being disposed to the second rail; the locking member passing through the chute to connect the locating member to the second rail; the guide post passing through the second rail and sliding on the guide section; and the guide post holding against the inclined guide edge; wherein the locating member retreats at an inclination from the chute, while the guide post slides along the inclined guide edge to allow the locating member deflecting at an angle while retreating at a certain inclination.

2. The automatic release retaining mechanism of a slide of claim 1, wherein a first elastic arm is provided to the elastic member to hold and rest on one side of the locating member.

* * * * *